United States Patent [19]

Yano et al.

[11] Patent Number: 4,820,118

[45] Date of Patent: Apr. 11, 1989

[54] VARIABLE-DISPLACEMENT TURBINE

[75] Inventors: Shunji Yano; Masato Hayama, both of Saitama, Japan

[73] Assignee: Honda Giken Kogyo Kabushiki Kaisha, Tokyo, Japan

[21] Appl. No.: 148,254

[22] Filed: Jan. 25, 1988

[30] Foreign Application Priority Data

Jan. 23, 1987 [JP] Japan ..... 62-13833

[51] Int. Cl.[4] ..... F04D 17/16

[52] U.S. Cl. ..... 415/161; 415/164

[58] Field of Search ..... 415/150, 151, 159, 160, 415/161, 163, 164

[56] References Cited

U.S. PATENT DOCUMENTS

| | | | |
|---|---|---|---|
| 2,428,830 | 10/1947 | Birmann | 415/163 X |
| 2,860,827 | 11/1958 | Egli | 415/164 |
| 3,101,926 | 8/1963 | Weber | 415/164 X |
| 3,972,644 | 8/1976 | Johnson | 415/163 |
| 4,657,480 | 4/1987 | Pfeil | 415/164 X |
| 4,678,397 | 7/1987 | Komatsu et al. | 415/163 X |

FOREIGN PATENT DOCUMENTS

| | | | |
|---|---|---|---|
| 710346 | 7/1941 | Fed. Rep. of Germany | 415/161 |
| 2178111 | 2/1987 | United Kingdom | 415/151 |

*Primary Examiner*—Robert E. Garrett
*Assistant Examiner*—Joseph M. Pitko
*Attorney, Agent, or Firm*—Lyon & Lyon

[57] ABSTRACT

A variable-displacement turbine includes a turbine wheel, and a turbine housing accommodating a turbine wheel and having an exhaust inlet tubular member for introducing a stream of exhaust gases from an engine, top and base plates having confronting parallel annular end surfaces, respectively, concentric with the turbine wheel, the top and base plates defining a passage for supplying and guiding the stream of exhaust gases through the exhaust inlet tubular member to the turbine wheel from its outer periphery, and a vane mechanism disposed annularly in surrounding relation to the turbine wheel and between the annular end surfaces. The vane mechanism includes a plurality of drive shafts rotatably extending through the base plate and disposed at substantially equally spaced angular intervals between the annular end surfaces, the drive shafts being rotatably actuatable by an actuator, and a plurality of movable vanes extending between the annular end surfaces, the movable vanes having base end portions mounted respectively on the drive shafts in slidable contact with the base plate and wing portions extending respectively from the base end portions and spaced from the base and top plates by distances, the movable vanes being tiltable between the annular end surfaces in response to rotation of the drive shafts, respectively, for regulating the stream of exhaust gases. The movable vanes can be tilted unobstructedly even if various members are subjected to thermal strains and/or dimensional errors.

8 Claims, 2 Drawing Sheets

VARIABLE-DISPLACEMENT TURBINE

BACKGROUND OF THE INVENTION

1. Field of the Invention:

The present invention relates to a variable-displacement turbine, and more particularly to a variable-displacement turbine for use in a turbocharger for use with an engine for an automobile or the like.

2. Description of the Relevant Art:

Variable-displacement turbines are used as exhaust turbines of variable-displacement turbochargers. One such variable-displacement turbine is disclosed in Japanese Patent Publication No. 38-7653.

The disclosed variable-displacement turbine has a turbine housing accommodating a turbine wheel therein and including a pair of parallel annular walls defining therebetween a passage for supplying and guiding a fluid (exhaust gases) to the turbine wheel from its outer periphery. An annular array of movable vanes is disposed between the walls of the turbine housing in surrounding relation to the turbine wheel, the movable vanes providing variable restrictions for passage of the fluid therethrough.

When the engine operates in a low-speed range, the movable vanes are tilted to reduce the opening of the variable restrictions to increase the supercharging effect in the low-speed range. Because the variable restrictions or nozzles are defined between the movable vanes, however, the opening of the variable restrictions is greatly affected by even a small change in the angle of inclination of the movable vanes. As a result, the opening of the variable restrictions cannot accurately be controlled insofar as the opening is relatively small.

Since the turbine housing and movable vanes in a general variable-displacement turbine are exposed to a stream of high-temperature exhaust gases, the turbine housing and movable vanes are subject to thermal strain, and hence the movable vanes may not smoothly be actuated.

SUMMARY OF THE INVENTION

In view of the aforesaid drawbacks of the conventional variable-displacement turbine, it is an object of the present invention to provide a variable-displacement turbine capable of accurately and smoothly controlling variable restrictions or nozzles even in a small opening range.

According to the present invention, there is provided a variable-displacement turbine comprising a turbine wheel supported on an output shaft, a support member by which the output shaft is rotatably supported, a vane casing including an annular base plate through which the output shaft rotatably extends and which is disposed concentrically rearwardly of the turbine wheel, an annular top plate having a central exhaust outlet opening and disposed parallel to the base plate concentrically forwardly of the turbine wheel, and a vane mechanism disposed annularly in surrounding relation to the turbine wheel and between confronting annular end surfaces of the base and top plates around entire peripheries thereof, and a turbine housing accommodating the vane casing therein and having an exhaust inlet tubular member for introducing a stream of exhaust gases from an engine through the vane mechanism, the turbine housing being coupled to the support member, the vane mechanism including a plurality of drive shafts rotatably extending through the base plate and disposed at substantially equally spaced angular intervals between the annular end surfaces, the drive shafts being rotatably actuatable by an actuator, and a plurality of movable vanes extending between the annular end surfaces, the movable vanes having base end portions mounted respectively on the drive shafts in slidable contact with the base plate and wing portions extending respectively from the base end portions and spaced from the base and top plates by distances, the movable vanes being tiltable between the annular end surfaces in response to rotation of the drive shafts, respectively, for regulating the stream of exhaust gases, the annular end surfaces of the base and top plates having stepped walls which will extend along outer peripheral surfaces of the movable vanes in a position in which the movable vanes are prevented from being tilted to allow the vane mechanism to have a minimum opening, the stepped walls having respective thicknesses greater than the distances.

The above and further objects, details and advantages of the present invention will become apparent from the following detailed description of a preferred embodiments thereof, when read in conjunction with the accompanying drawings.

DETAILED DESCRIPTION OF THE PREFERRED EMBODIMENT

Figure 1:
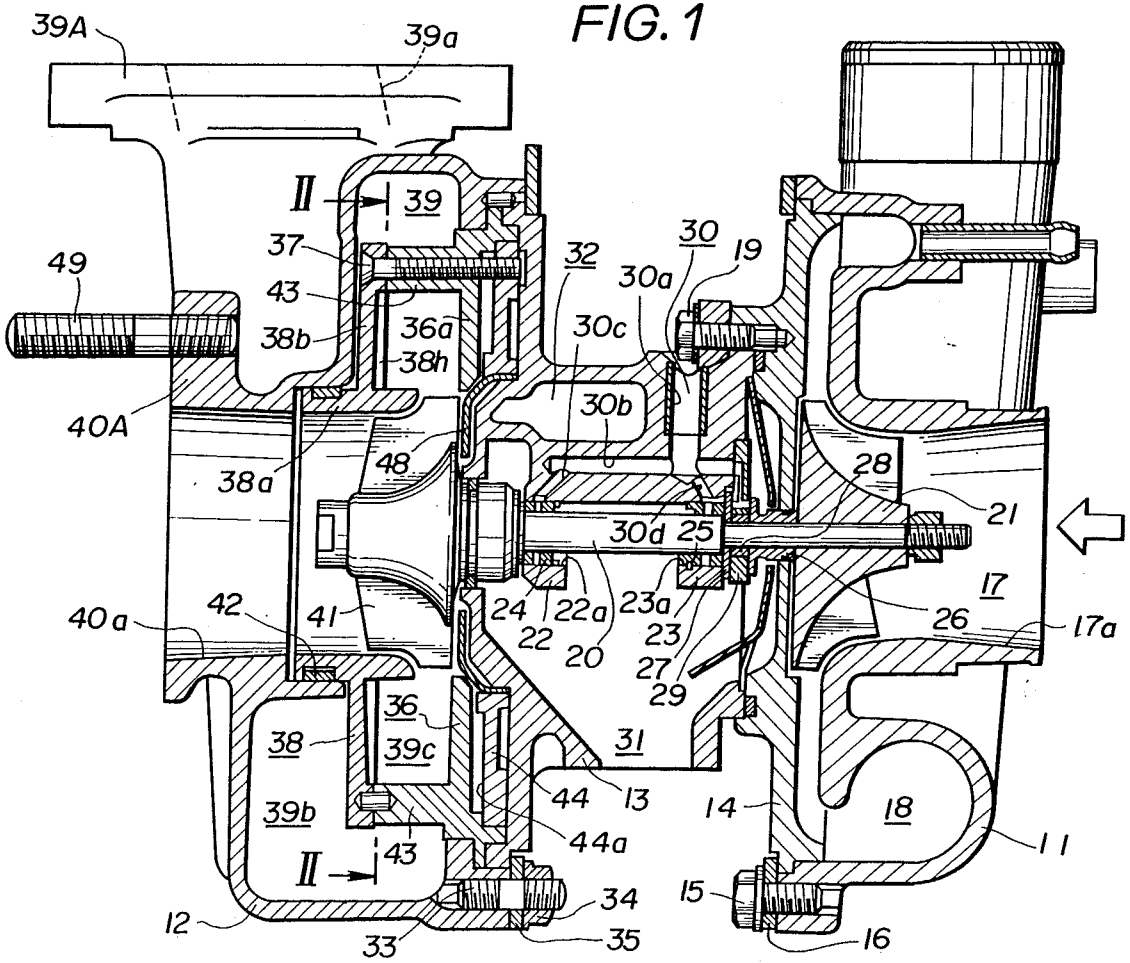
FIG. 1 is a vertical cross-sectional view of a turbocharger incorporating a variable-displacement turbine according to the present invention.

FIG. 1 shows a turbocharger for use with an automotive engine or the like in which a variable-displacement turbine according to the present invention is incorporated.

As shown in FIG. 1, the turbocharger includes a compressor housing 11 accommodating a compresser wheel 21 rotatably therein, a turbine housing 12 accommodating a turbine wheel 41 rotatably therein, and a central housing 13 in which there is rotatably supported a shaft 20 that interconnects the compressor wheel 21 and the turbine wheel 41. The compressor housing 11 and the turbine housing 12 are joined to each other by the central housing 13 located therebetween.

The compressor casing 11 is of an annular shape having an open end (shown as a lefthand end in FIG. 1) to which a back plate 14 is secured by bolts 15 and an attachment plate 16, and defines therein an axial passage 17 and a scroll passage 18. The back plate 14 is fastened to the central housing 13 by bolts 19. The axial passage 17 has a lefthand end (FIG. 1) coupled to a central area of the scroll passage 18. The compressor wheel 21 supported on a righthand end of the shaft 20 is rotatably disposed in the area where the axial passage 17 and the scroll passage 18 are joined to each other. The axial passage 17 has a righthand air inlet opening 17*a* for introducing intake air. The scroll passage 18 has an upper outlet opening (not shown) leading to a combustion chamber of the engine.

The central housing 13 has two bearing supports 22, 23 axially spaced from each other and having respective bearing holes 22*a*, 23*a*. The shaft 20 is rotatably supported by float bearings 24, 25 disposed respectively in the bearing holes 22*a*, 23*a*. The righthand end of the shaft 20 extends rotatably through a bushing 26 into the compressor housing 11 in which the shaft 20 is coupled to the compressor wheel 21, the bushing 26 being supported on the back plate 14. A washer 27, a collar 28, and a thrust bearing 29 are interposed between a step of the shaft 20 and the bushing 26.

The central housing 13 has an oil supply passage 30 defined therein above the bearing supports 22, 23 for supplying lubricating oil to the float bearings 24, 25, and an oil drain hole or passage 31 defined below the bearing supports 22, 23 for discharging lubricating oil downwardly of the bearing supports 22, 23. The oil supply passage 30 includes an oil inlet hole 30*a* having an open upper end, a lateral hole 30*b* communicating with the lower end of the oil inlet hole 30*a* and opening at a sliding surface of the thrust bearing 29, and two oil distribution holes 30*c*, 30*d* communicating with the lateral hole 30*b* and opening at peripheral surfaces of the bearing holes 22*a*, 23*a*, respectively. The open upper end of the oil inlet hole 30*a* is connected to a lubricating oil supply source (not shown) such as an oil pump. The oil drain passage 31 has an open lower end connected to an oil pan or the like (not shown). The oil supply passage 30 supplies lubricating oil from the lubricating oil supply source to the bearings 24, 25, 29 to lubricate and cool them, and the oil drain passage 31 discharges lubricating oil to the oil pan for reuse of the lubricating oil.

The central housing 13 has a water jacket 32 which is defined therein more closely to the turbine housing 12 than the oil supply passage 30 and the oil drain passage 31 are. The water jacket 32 has a lower water inlet for introducing cooling water into the water jacket 32, and an upper water outlet for discharging cooling water out of the water jacket 32. The water jacket 32 serves to prevent heat transfer from the turbine housing 12, and vaporize cooling water at the time of the heat soak back to cool the bearing supports 22, 23 with the heat of vaporization.

Stud bolts 33 are threaded into an end surface of the turbine housing 12, which is fixed to the central housing 13 by an attachment plate 35 that is fastened to the stud bolts 33 by nuts 34. The turbine housing 12 is substantially annular in shape and has a lefthand open end closed by a base plate 36 with its outer peripheral edge clamped between the turbine housing 12 and the central housing 13. The turbine housing 12 defines therein a scroll passage 39 extending concentrically with the turbine wheel 41 and an outlet passage 40A extending concentrically with the turbine wheel 41 and connected centrally to the scroll passage 39, the outlet passage 40A leading leftwardly and having an exhaust outlet 40*a* opening at its lefthand end. The turbine housing 12 includes an integral exhaust inlet tubular member 39A opening tangentially into the scroll passage 39 and having an exhaust inlet 39*a* in its outer end. The central area of the scroll passage 39 communicates with the righthand end of the outlet passage 40A, and the turbine wheel 41 supported on the lefthand end of the shaft 20 is rotatably disposed in the area where the scroll passage 39 and the outlet passage 40 are joined to each other. The turbine wheel 41 is housed in a vane casing comprising a top plate 38, the base plate 39, and a vane mechanism (described later). The vane casing divides the central area of the scroll passage 39 into an outer passageway 39*b* and an inner passageway 39*c*.

The base plate 36 comprises an annular disc portion 36*a* through which the shaft 20 rotatably extends, and four fixed vanes 43 extending from the outer periphery of the disc portion 36*a* axially toward the top plate 38. A thermal insulation plate 44 is fitted in the base plate 36 on an end surface thereof facing the central housing 13, thus providing a thermal insulation layer 44*a* defined between itself and the disc portion 36*a*.

The top plate 38 comprises an inner cylindrical portion 38*a* fitted in an inner end of the outlet passage 40A with a seal ring 42 interposed therebetween; and an annular disc portion 38*b* integral with and extending radially outwardly from the outer peripheral surface of the inner cylindrical portion 38*a* at its axially central area. The turbine wheel 41 has its front portion rotatably positioned in and surrounded by a rear opening of the cylindrical portion 38*a* with a prescribed clearance therebetween. The top plate 38 is fastened to the base plate 36 by bolts 37 which project from the turbine housing 12 through the disc portion 38*b* and the fixed vanes 40 of the base plate 36 threadedly into the base plate 44. The annular disc portion 38*b* of the top plate 38 and the annular disc portion 36*a* of the base plate 36 lie parallel to each other concentrically with the turbine wheel 41.

The bolts 37 have tip ends projecting through the thermal insulation plate 44 toward the central housing 13, and the projecting tip ends of the bolts 37 are welded to the surface of the thermal insulation plate 44 facing the central housing 13, so that the bolts 37 will not be loosened.

The base plate 36 has stepped walls 36*g* (see FIG. 2) complementary in shape to movable vanes 45 and serving as stoppers for preventing the movable vanes 45 from being tilted at the time variable restrictions 46 (described later) are of a minimum opening, the stepped walls 36*g* being on the inner surface of the annular disc portion 36*a* facing the top plate 38 and on which the fixed vanes 43 are disposed. Likewise, the top plate 38a lso has stepped walls 38*h* (see FIG. 3) complementary in shape to the movable vanes 45.

Figure 2:
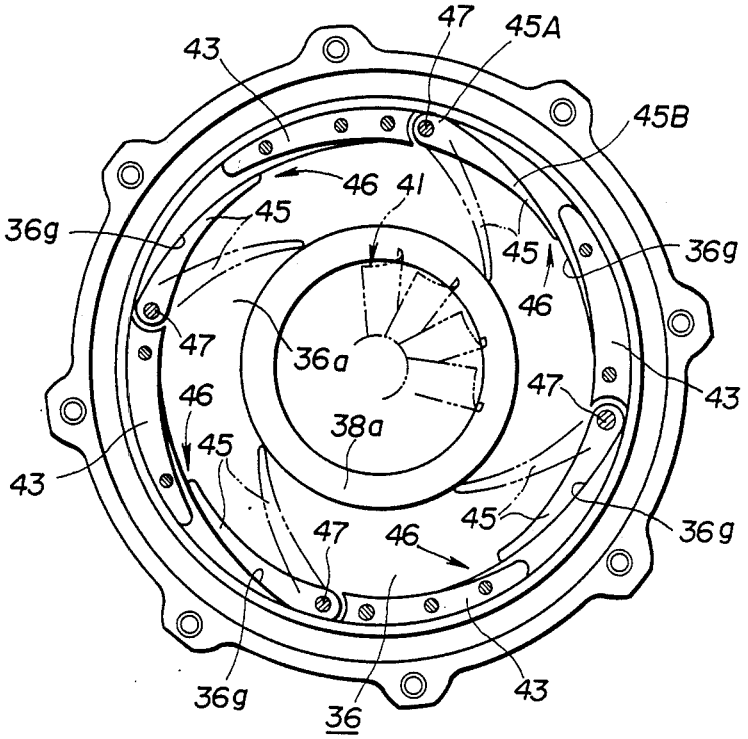
FIG. 2 is a cross-sectional view taken along line II—II of FIG. 1, showing the variable-displacement turbine.

As illustrated in FIG. 2, the fixed vanes 43 have arcuate shapes having arcuate outer peripheral surfaces defining arcs of a single circle concentric with the turbine wheel 41 and surrounding the turbine wheel 41. The fixed vanes 43 are spaced with given gaps therebetween in the direction in which the turbine wheel 41 rotates. Four arcuate movable vanes 45 are disposed respectively in the gaps between the fixed vanes 43.

Figure 3:
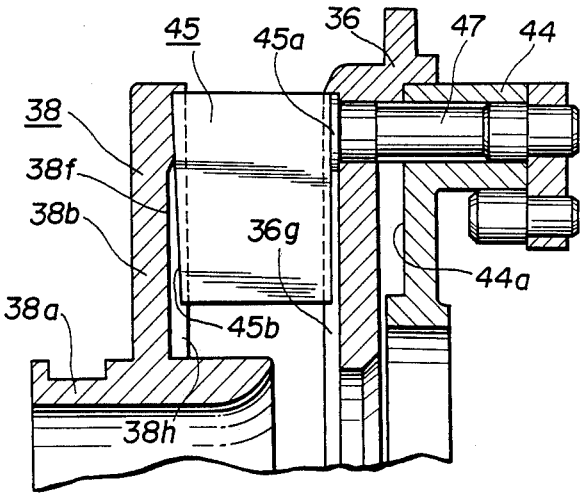
FIG. 3 is an enlarged fragmentary cross-sectional view of the turbine.

As shown in FIGS. 2 and 3, each of the movable vanes 45 comprises a base end portion 45A fitted over one of an annular array of equally angularly spaced pins or drive shafts 47 rotatably extending through and projecting from the annular disc portion 36*a* of the base plate 36, and a wing portion 45B extending from the base end portion 45A. At least the wing portion 45B has an arcuate outer peripheral surface similar to that of each fixed vane 43. Thus, the outer arcuate surfaces of the movable and fixed vanes 45, 43 provide the arcs of the circle concentric with the turbine wheel 41. As shown in FIG. 3, the movable vane 45 has a boss 45*a* projecting from a marginal edge of the base end portion 45A which faces the base plate 36 toward the base plate 36 coaxially with the pin 47. The movable vane 45 also includes a tapered surface 45*b* on its marginal edge facing the top plate 38 and inclined at an angle toward the base plate 36 in a direction from the base end portion 45A toward the tip end of the wing portion 45B. Thus, the boss **45*a* projects from the marginal edge of the base end portion 45A toward the base plate 36, and the marginal edge of the movable vane 45 facing the top plate 38 is progressively more spaced from the top plate 38 in the direction from the base end portion 45A toward the tip end of the wing portion 45B. The movable vane 45** is therefore in the form of a tapered plate member.

The boss **45*a* has a height (thickness) smaller than that of the stepped wall 36*g* so that the edge of the outer peripheral surface of the wing portion 45B of the movable vane 45 can contact the stepped wall 36*g* irrespective of whether the movable vane 45 is hot or cold. On the side of the marginal edge of the movable vane 45 facing the base plate 36, only the boss 45*a* is slidably held against the base plate 46. Since the marginal edge of the movable vane 45 facing the top plate 38 is the tapered surface 45*b* progressively more spaced from the top plate 38 in the direction toward the tip end of the movable vane 45, the movable vane 45 absorbs any thermal strain of the top plate 38, thereby preventing the movable vane 45 from biting into the top plate 38 when such thermal strain is developed. The tapered surface 45*b* is inclined such that the tip end of the movable vane 45 can be held against the stepped wall 38*h* irrespective of whether the movable vane 45 is hot or cold. The movable vane 45 should preferably be shaped such that the entire edge of the outer peripheral surface of the movable vane 45 is held against the stepped wall 38*h* when the movable vane 45** is thermally deformed to a maximum extent.

The end surface of the top plate 38 on which the stepped walls **38*h* are disposed and which faces the movable vanes 45 should preferably have a recess 38*f* (FIG. 3) extending in an angular range in which the edge of at least the wing portion 45B of the movable vane 45 sweeps upon tilting movement of the movable vane 45. The recess 38f has a large depth to the left in FIG. 3**.

In response to rotation of the pins 47, the movable vanes 45 are tilted thereabout while holding the tips ends of the bosses **45*a* in sliding contact with the bsae plate 36, for thereby varying the cross-sectional area of flow passages or opening of the variable restrictions 46. When the movable vanes 45 abut against the stepped walls 36*g* of the base plate 36 and the stepped wall 38*h* of the top plate 38, the variable restrictions 46 are of a minimum opening. The opening of the variable restrictions 46 is increased when the movable vanes 45 are tilted radially inwardly from the minimum-opening position. The pins 47 have ends projecting toward the central housing 13 and operatively connected to an actuator (not show) through a link mechanism disposed between the central housing 13 and the base plate 36. Therefore, the pins 47** can be rotated about their axes by the actuator.

Referring back to FIG. 1, a disc-shaped shield 48 is clamped between the inner peripheral edge of the thermal insulation plate 44 and an outer peripheral wall of the central housing 13. The shield 48 serves, in cooperation with the thermal insulation plate 44, to prevent the heat of exhaust gases from being transferred from the turbine housing 12 to the central housing 13. The turbine housing 12 can be installed on a suitable mount (not shown) by means of a stud bolt 49 with one end threaded in the turbine housing 12.

In this embodiment, the fixed vanes 43, the movable vanes 45, and the pins or drive shafts 47 coupled to the actuator jointly provide the variable restrictions 46 of the vane mechanism for supplying a regulated stream of exhaust gases from the outer peripheral region of the turbine wheel 41. The vane mechanism is disposed between the annular end surfaces of the top plate 38 and the base plate 36, i.e., the disc portion **38*b* and the disc portion 36*a*. The vane casing, which is composed of the top plate 38, the base plate 36, and the vane mechanism, is disposed centrally in the scroll passage 39 with which the righthand end of the outlet passage 40A in the turbine housing 12 communicates. The vane mechanism of the vane casing divides the central area of the scroll passage 39 into the outer passageway 39*b* and the inner passageway 39*c***, as described above.

Operation of the variable-displacement turbine will be described below. When the speed of rotation of the engine is relatively low and the amount of exhaust gases emitted from the engine is small, the movable vanes 45 are positioned in contact with the stepped walls **36*g*, 36*h* as shown in FIG. 3 to minimize the opening of the variable restrictions 46. Therefore, the exhaust gases introduced from the exhaust inlet 39*a* flow from the outer passageway 39b through the variable restrictions 46 (vane mechanism) into the inner passageway 39*c* at an increased speed, and swirl in the inner passageway 39*c* to drive the turbine wheel 41. Therefore, the compressor wheel 21 is rotated at a high speed to pressurize and charge intake air into the engine combustion chamber. Thus, the engine is well supercharged while it is operating at low speed. At this time, since the marginal edges of the movable vanes 45 are held against the stepped walls 36*g*, 38*h*, the exhaust gases are prevented from leaking outfrom between the movable vanes 45 and the stepped walls 36*g*, 38*h***, resulting in a high degree of efficiency.

When the speed of rotation of the engine is increased and so is the amount of exhaust gases emitted therefrom, the movable vanes 45 are angularly moved radially inwardly to increase the opening of the variable restrictions 46 (vane mechanism) dependent on the speed of rotation of the engine. Therefore, an appropriate supercharging effect according to the engine operating condition can be ensured. The resistance to the flow of the exhaust gases is reduced, and so is the back pressure of the exhaust gases, without need for any special wastegate and control valve which would otherwise have to be combined with the turbocharger. The turbine wheel 41 is rotated by the exhaust gases to enable the compressor wheel 21 to pressurize and charge intake air into the engine.

In the variable-displacement turbine of the present invention, each movable vane 45 has the boss **45*a* disposed on the surface of the base end portion 45A thereof facing the base plate 36 and abutting against the base plate 36. The movable vane 45 is tiltable while the tip end of the boss 45*a* is sliding against the base plate 36. Therefore, the resistance to sliding or frictional movement of the movable vanes 45 with respect to the base plate 36 is small, and so is the power required to actuate the movable vanes 45. Accordingly, the actuator for actuating the movable vanes 45** may be smaller in size.

The tip end of each movable vane 45 is spaced from the base plate 36 by the boss **45*a*. Consequently, even when the pin 47 or the base plate 36 is subjected to thermal strain due to a localized temperature difference or when the movable vane 45 is displaced outwardly due to a strain of the pin 47 arising from the difference between the temperatures of the bearing portions of the base plate 36 and the thermal insulation plate 44 for the pin 47, the movable vane 45 will not bite into the base plate 36** and can smoothly be operated when it is tilted.

The movable vane 45 is also spaced from the top plate 38 by the tapered surface 45*b*. The gap between the movable vane 45 and the top plate 38 is effective to absorb a strain of the top plate 38 and an outward displacement of the movable vane 45 due to the temperature difference between the bearing portions for the pin 47. Therefore, the movable vane 45 is also prevented from biting into the top plate 38 and is allowed to operate smoothly.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

We claim:

1. A variable-displacement turbine comprising:

a turbine wheel supported on an output shaft;

a support member by which said output shaft is rotatably supported;

a vane casing including an annular base plate through which said output shaft rotatably extends and which is disposed concentrically rearwardly of said turbine wheel, an annular top plate having a central exhaust outlet opening and disposed parallel to said base plate concentrically forwardly of said turbine wheel, and a vane mechanism disposed annularly in surrounding relation to said turbine wheel and between confronting annular end surfaces of said base and top plates around entire peripheries thereof;

a turbine housing accommodating said vane casing therein and having an exhaust inlet tubular member for introducing a stream of exhaust gases from an engine through said vane mechanism, said turbine housing being coupled to said support member;

said vane mechanism including a plurality of drive shafts rotatably extending through said base plate and disposed at substantially equally spaced angular intervals between said annular end surfaces, said drive shafts being rotatably actuatable by an actuator, and a plurality of movable vanes extending between said annular end surfaces, said movable vanes having base end portions mounted respectively on said drive shafts in slidable contact with said base plate and wing portions extending respectively from said base end portions and spaced from said base and top plates by distances, said movable vanes being tiltable between said annular end surfaces in response to rotation of said drive shafts, respectively, for regulating said stream of exhaust gases, and said annular end surfaces of the base and top plates having stepped walls which will extend along outer peripheral surfaces of said movable vanes in a position in which the movable vanes are prevented from being tilted to allow said vane mechanism to have a minimum opening, said stepped walls having respective thicknesses greater than said distances.

2. A varible-displacement turbine according to claim 1, wherein said vane mechanism further includes a plurality of fixed vanes disposed between said annular end surfaces along entire peripheries thereof and angularly spaced by gaps, said fixed vanes extending axially from said base plate and joined to said top plate, said movable vanes being disposed respectively in said gaps for adjusting the opening of said gaps.

3. A variable-displacement turbine according to claim 2, wherein said movable vanes and said fixed vanes have outer arcuate peripheral surfaces defining arcs of a circle concentric with said turbine wheel.

4. A variable-displacement turbine according to claim 1, wherein said base end portions of the movable vanes have bosses slidably held against said base plate and having thicknesses smaller than the thicknesses of said stepped walls, said base end portions being mounted on said drive shafts, respectively, through said bosses.

5. A variable-displacement turbine according to claim 1, wherein said movable vanes comprise plate members having marginal edges progressively tapered toward tip ends of said wing portions so as to be progressively more spaced from said top plate within the thicknesses of said stepped walls.

6. A variable-displacement turbine according to claim 5, wherein the end face of said top plate which has said stepped walls has a recess defined in a range in which marginal edges of at least said wings of the movable vanes sweep when said movable vanes are tilted.

7. A variable-displacement turbine according to claim 1, wherein said central exhaust outlet opening is defined by a cylindrical member having a rear opening surrounding a front portion of said turbine wheel with a gap therebetween, said cylindrical member extending concentrically forwardly of said turbine wheel.

8. A variable-displacement turbine according to claim 7, wherein said turbine housing comprises an annular member having a scroll passage communicating with said exhaust inlet tubular member and having a central wall defined by said vane mechanism for introducing said stream of exhaust gases, and an exhaust outlet passage in which said cylindrical member of the top plate is fitted.

* * * * *